United States Patent [19]

Landtwing

[11] Patent Number: 5,076,334

[45] Date of Patent: Dec. 31, 1991

[54] QUICK-CLAMPING DEVICE OPERATED BY CENTRIFUGAL FORCE, FOR PLANING BLADES

[76] Inventor: Peter Landtwing, Obere Rostmatt 1, CH-6301 Zug, Switzerland

[21] Appl. No.: 613,220

[22] Filed: Nov. 14, 1990

[30] Foreign Application Priority Data

Nov. 17, 1989 [EP] European Pat. Off. ..... 89121318.3

[51] Int. Cl.[5] ..... B27G 13/00

[52] U.S. Cl. ..... 144/230; 144/241; 407/50; 407/91; 407/108

[58] Field of Search ..... 407/47, 49, 50, 91, 407/107-109; 144/230, 241, 218

[56] References Cited

U.S. PATENT DOCUMENTS 3,017,912 1/1962 Sybertz et al. ..... 144/230
3,865,164 2/1975 Sybertz et al. ..... 144/230
3,868,751 3/1975 Holthuis ..... 407/49 X
4,470,442 9/1984 Krautzberger et al. ..... 144/230
4,557,305 12/1985 Berger et al. ..... 144/241 X

FOREIGN PATENT DOCUMENTS 2306053 10/1976 France ..... 144/230

*Primary Examiner*—Daniel W. Howell
*Assistant Examiner*—J. Daulton
*Attorney, Agent, or Firm*—William W. Jones

[57] ABSTRACT

A centrifugally operated clamping device for clamping a reversible blade insert in a planing tool ensures positive engagement between the clamp and the blade. The clamping device includes a clamping wedge which has an inverted T-shaped cross-section and is positioned in a similarly configured groove in the tool. The wedge is biased relative to the bottom of the groove so that the clamp will be easily disconnected from the blade.

5 Claims, 2 Drawing Sheets

QUICK-CLAMPING DEVICE OPERATED BY CENTRIFUGAL FORCE, FOR PLANING BLADES

TECHNICAL FIELD

The invention relates to a quick-clamping device operated by centrifugal force, for clamping a disposable, reversible blade to the cutter head or the cutter shaft of a planing machine.

BACKGROUND ART

In a known quick-clamping system of the type mentioned, an angular profiled ledge is provided in addition to a centrifugal wedge for clamping a reversible blade in the respective groove of a rotating cutter shaft. The ledge engages with its longitudinal rib in a channel in the, as seen in the direction of rotation of the cutter shaft, front side surface of the reversible blade. A desired rapid blade change may be realized therein by first releasing the blade clamping effect by means of a light stroke applied to the centrifugal wedge. Withdrawal of the reversible blade from the groove of the cutter shaft as well as re-insertion thereof after blade reversal or insertion of a new blade can be carried out in the axial direction of the cutter shaft, and thereafter automatic clamping of the entire system can be effected by the centrifugal force occurring during rotation of said system.

A serious disadvantage of the known system consists in that no measures are provided therein for preventing hurling away of centrifugal wedge and angular profiled ledge from the respective groove in the cutter shaft in case the planing machine is erroneously put into operation without having reversible blades inserted therein.

DISCLOSURE OF THE INVENTION

It is thus an object of the present invention to provide a quick-clamping device of the type indicated at the outset, which renders possible rapid blade change and safe clamping of disposable, reversible blades while at the same time avoiding the risk of accidents and/or damage to parts of the planing machine.

To meet this object, a quick-clamping device is proposed having the features according to the characterizing part of patent claim 1.

The quick-clamping device according to the invention permits instant, safe clamping of the disposable, reversible blade immediately upon starting of the planing machine. Due to the configuration of the centrifugal clamping wedge, i.e. the clamping wedge operable by centrifugal force, and of the groove cross-section in the tool base body, hurling of said clamping wedge out of the particular groove of the cutter head or cutter shaft is rendered impossible.

Furthermore, due to the design of the centrifugal clamping wedge, as will be described in more detail below, a surprisingly simple blade change is rendered possible as well.

Features of a particularly advantageous development of the invention can be gathered from dependent patent claims 2 to 7.

BRIEF DESCRIPTION OF THE DRAWINGS

The invention will be elucidated in more detail by way of two preferred embodiments with reference to the drawings in which.

BEST MODE FOR CARRYING OUT THE INVENTION

Figure 1:
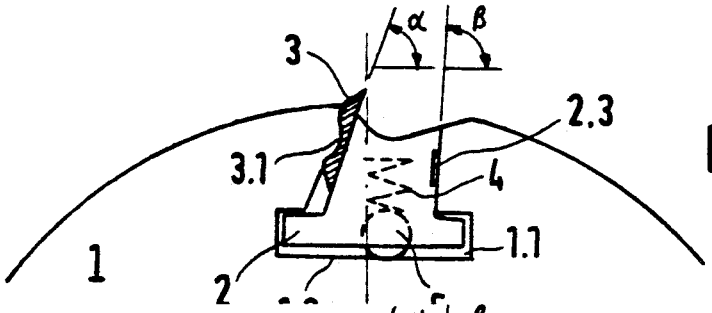
FIG. 1 shows a cross-section through a first embodiment of the quick-clamping device operated by centrifugal force, for clamping a disposable, reversible blade to the cutter head or the cutter shaft of a planing machine according to the invention, illustrating the blade in clamped condition.
Figure 1:
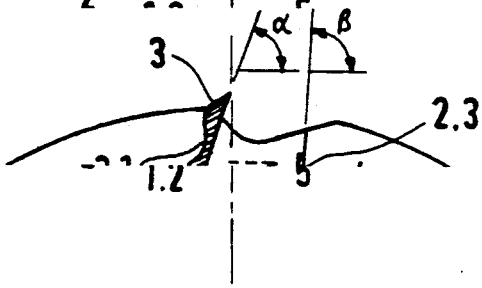

As can be seen from FIGS. 1, 2 and 4 to 6, the rotatable tool base body 1 of a planing machine has axially extending grooves 1.1 formed therein. In each groove 1.1, there is disposed a centrifugal clamping wedge 2, i.e. a clamping wedge operable by centrifugal force, by means of which one disposable, reversible blade 3 each can be clamped.

Figure 2:
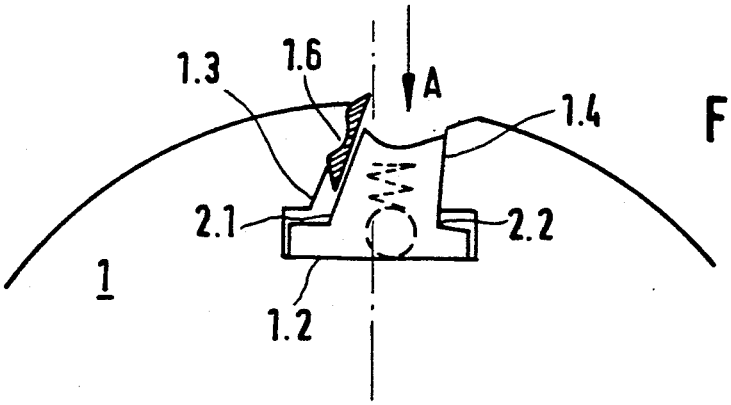
FIG. 2 shows the cross-sectional drawing according to FIG. 1, however, the blade being released from the clamped condition and being adapted to be withdrawn in axial direction of the tool base body.
Figure 3:
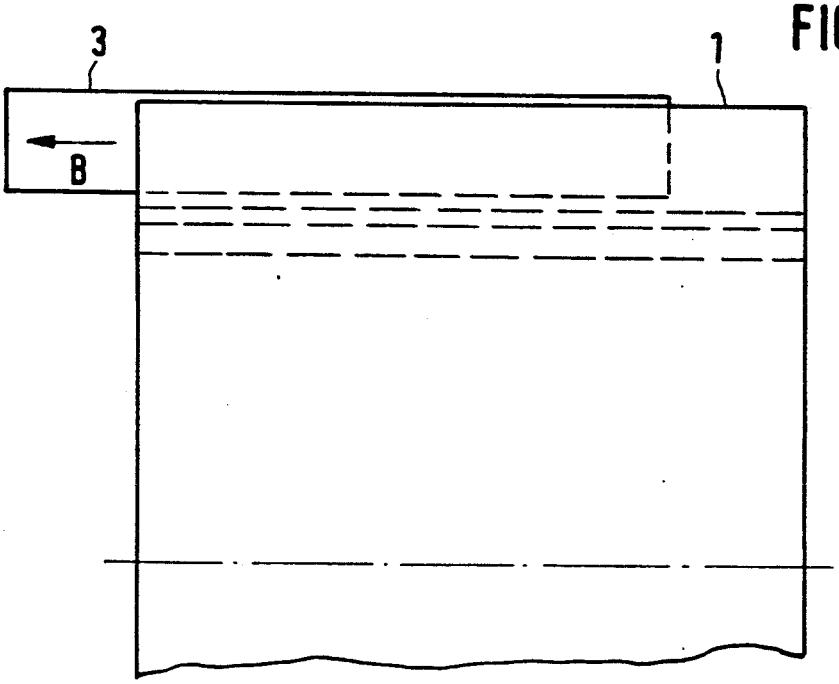
FIG. 3 shows a front elevation of the tool base body according to FIGS. 1 and 2 with axially partially withdrawn blade.

Groove 1.1 and centrifugal clamping wedge 2 are provided in like manner with a cross-sectional configuration resembling in essence an inverted T-shape. The centrifugal clamping wedge 2 is supported against the groove bottom 1.2 via a number of resilient intermediate members, preferably springs 4, the springs 4, as seen in the cross-sectional illustration of the groove 1.1 (cp. FIGS. 1, 2 and 4 to 6), being mounted in non-symmetrical manner with respect to the center of the groove bottom 1.2. In a first embodiment of the quick-clamping device according to the invention, as shown in FIGS. 1 to 3, a thrusting member in the form of a ball 5 is expediently provided between each spring 4 and the groove bottom 1.2 for ensuring exact guiding of the centrifugal clamping wedge 2 upon depression thereof in the direction of arrow A for release of the disposable, reversible blade 3 from the clamped condition or for inserting the same. After release of the disposable, reversible blade 3 has been carried out, removal thereof is possible in the axial direction (cp. arrow B in FIG. 3).

In a second embodiment of the invention according to FIGS. 4 to 7, the centrifugal clamping wedge 2 is provided in particularly advantageous manner with a configuration such that, in the clamped operative condition thereof, the bottom surface thereof assumes an inclined position with respect to the groove bottom 1.2. In this position the axial bottom edge of the centrifugal clamping wedge 2 located on the side of the disposable, reversible blade 3 is closer to the groove bottom 1.2. When the centrifugal clamping wedge 2 is depressed in the direction of arrow C in FIG. 5 for releasing the disposable, reversible blade 3 from the clamped condition or for insertion thereof, the clamping wedge 2 pivots about said bottom edge functioning as a pivotal axis, in the direction of arrow D in FIG. 6 until the bottom surface thereof snugly rests on the groove bottom 1.2, and at the same time it releases the disposable reversible blade 3 for withdrawal thereof in the radial direction (cp. arrow E in FIG. 7).

The lateral surfaces 2.1, 2.2 of the erect central part of the centrifugal clamping wedge 2, which extend in axial direction of the tool base body 1, as well as the lateral surfaces 1.3, 1.4 of the groove 1.1. which are respectively adjacent thereto are each inclined at an acute angle of inclination $\alpha,\beta$ with respect to the groove bottom 1.2. The angle of inclination $\alpha$ of those adjacent lateral surfaces 1.3 and 2.1 of groove 1.1 and centrifugal clamping wedge 2, respectively, between which the particular disposable, reversible blade 3 is clamped, is smaller than the angle of inclination $\beta$ of the respective other lateral surfaces 1.4 and 2.2 of said respective parts.

Figure 4:
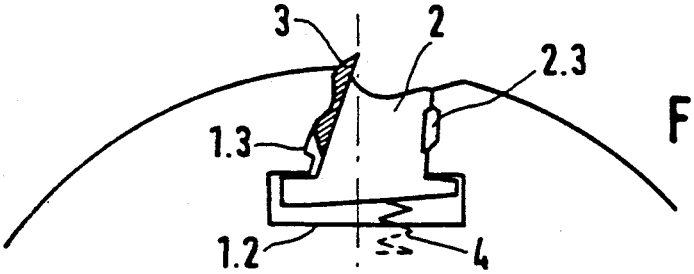
FIG. 4 shows a cross-section through a second embodiment of the quick-clamping device according to the invention, again illustrating the blade in the clamped condition.
Figure 5:
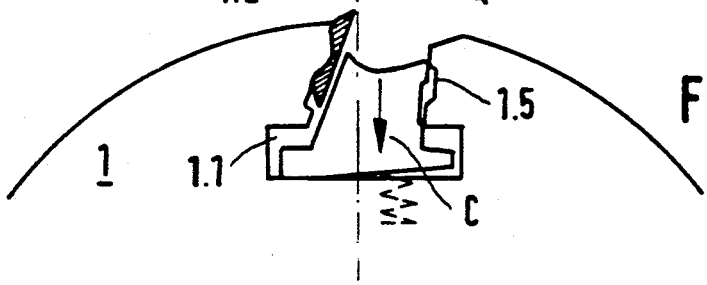
FIG. 5 shows the cross-sectional drawing according to FIG. 4, however, the blade being released from the clamped condition.
Figure 6:
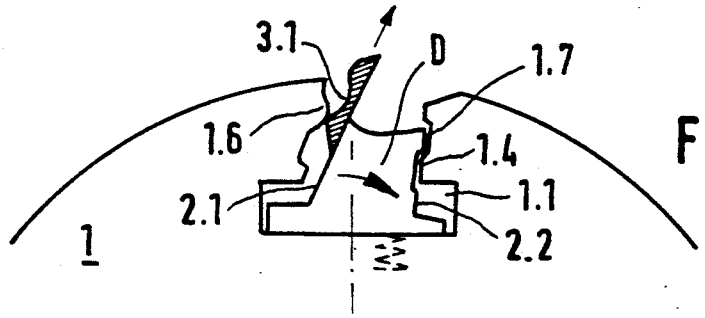
FIG. 6 shows the cross-sectional drawing according to FIG. 4, however, the blade being released for withdrawal thereof in radial direction.
Figure 7:
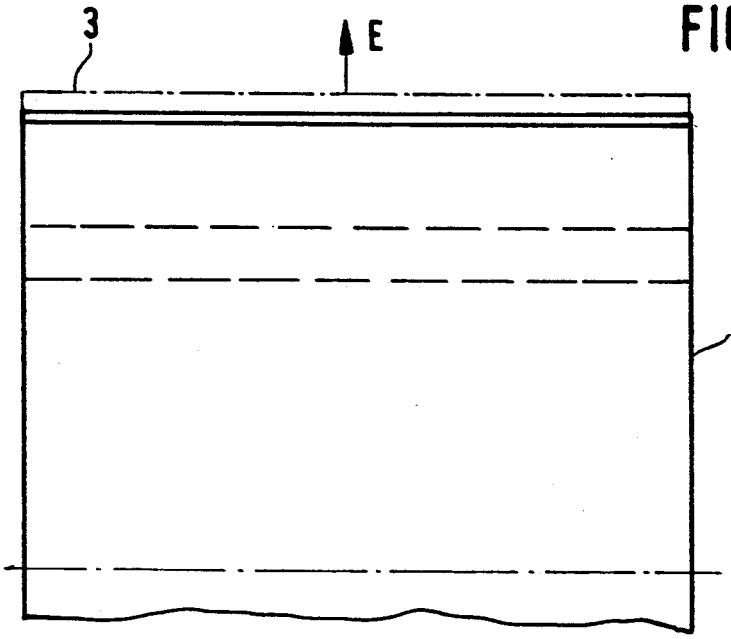
FIG. 7 shows a front elevation of the tool base body according to FIGS. 4 to 6 with radially partially withdrawn blade.

The last-mentioned lateral surface 1.4 of the groove 1.1 and the lateral surface 2.2 of the centrifugal clamping wedge 2 cooperating therewith are each formed with an axially extending recess 1.5 and 2.3, respectively. A wedge nose 1.7 created thereby above recess 2.3 is adapted, upon depression of the centrifugal clamping wedge 2, to tilt into the recess 1.5 of the lateral surface 1.4 of the groove 1.1 and is thus adapted to render possible withdrawal of the disposable, reversible blade 3 from said groove 1.1 in radial direction (cp. FIGS. 4 to 6).

For centered receipt of the disposable, reversible blade 3, the associated lateral surface 1.3 of the groove 1.1, furthermore, is formed with a rib 1.6 cooperating with an axially extending curved portion 3.1 on the rear side of the disposable, reversible blade 3 (cp. FIG. 6).

What is claimed is:

1. A releasable clamping assembly for clamping a blade to a rotatable part of a planing machine, said assembly comprising:

a) a generally T-shaped groove formed in said machine part, said groove when viewed in cross section, having a relatively broad base which opens into a narrowed slot extending through a side wall of said machine part, said base defining a pair of coplanar opposed stop shoulders flanking said slot;

b) a generally T-shaped wedge disposed in said groove, said wedge having a stem disposed in said groove slot, and a transversely enlarged head disposed in said groove base, said head defining stop flanges facing said stop shoulders;

c) a blade disposed in said groove slot adjacent to said wedge, said blade being unconnected to said wedge; and d) spring means in said groove base, said spring means being operable to bias said wedge radially, and against said blade to clamp said blade between said wedge and a first side wall of said groove slot, and to bias said stop flanges against said stop shoulders.

2. The clamping assembly of claim 1 wherein said first side wall of said groove slot has a rib which projects toward said wedge, and wherein said blade has a recess matching said rib, said wedge being operable to urge said rib and recess into mating contact whereby said blade is restrained against radial movement relative to said machine part.

3. The clamping assembly of claim 2 wherein a second sidewall of said groove slot opposite said first side wall has a first medial depression flanked by a first pair of ridges, and wherein said wedge has an adjacent side wall which faces said second side wall, and which has a second medial depression flanked by a second pair of ridges which substantially mirror said first medial depression and ridges, and wherein said spring means is operable to bias said first and second pairs of ridges into face-to-face contact during clamping of said blade, and said wedge being manually movable against the bias of said spring means to cause said first and second medial depressions to receive opposite ones of said first and second ridges respectively, whereby said wedge can be rocked away from said blade to allow the latter to be moved radially out of said groove.

4. The clamping assembly of claim 3 wherein said spring means is disposed to a side of said wedge remote from said blade to cam said wedge laterally toward said blade.

5. The clamping assembly of claim 4 wherein said wedge has a bottom surface which is spaced apart from a corresponding bottom surface of said groove, and wherein said wedge bottom surface is oblique to said groove bottom surface when said wedge is in its clamping position, whereby rocking movement of said wedge to release said blade is enhanced by bringing said respective bottom surfaces into parallel substantially face-to-face positions against the bias of said spring means. .

* * * * *